US010900309B2

(12) United States Patent
Robertson et al.

(10) Patent No.: US 10,900,309 B2
(45) **Date of Patent: *Jan. 26, 2021**

(54) SETTING TOOL FOR DOWNHOLE APPLICATIONS

(71) Applicant: Robertson Intellectual Properties, LLC, Arlington, TX (US)

(72) Inventors: Michael C. Robertson, Arlington, TX (US); Douglas J. Streibich, Fort Worth, TX (US); Antony F. Grattan, Mansfield, TX (US); Roy L. Sparkman, Haltom City, TX (US); Mark Lancaster, Alvarado, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/371,981

(22) Filed: Apr. 1, 2019

(65) Prior Publication Data

US 2019/0330946 A1 Oct. 31, 2019

Related U.S. Application Data

(63) Continuation of application No. 14/930,369, filed on Nov. 2, 2015, now Pat. No. 10,246,961, which is a continuation-in-part of application No. 13/507,732, filed on Jul. 24, 2012, now Pat. No. 9,863,235.

(60) Provisional application No. 62/073,704, filed on Oct. 31, 2014.

(51) Int. Cl.

| | |
|---|---|
| ***E21B 23/06*** | (2006.01) |
| ***C06B 33/02*** | (2006.01) |
| ***C06D 5/06*** | (2006.01) |

(52) U.S. Cl.

CPC ..... *E21B 23/06* (2013.01); *C06B 33/02* (2013.01); *C06D 5/06* (2013.01); *E21B 23/065* (2013.01)

(58) Field of Classification Search

CPC ..... E21B 23/06; E21B 23/065; C06B 33/02; C06D 5/06

See application file for complete search history.

(56) References Cited

U.S. PATENT DOCUMENTS

| | | | | |
|---|---|---|---|---|
| 3,244,232 | A | 4/1966 | Myers | |
| 5,398,951 | A | 3/1995 | Ross | |
| 7,591,319 | B2 | 9/2009 | Xu | |
| 7,669,661 | B2 * | 3/2010 | Johnson | E21B 23/04 166/373 |
| 7,828,052 | B2 | 11/2010 | Obrejanu | |

(Continued)

*Primary Examiner* — Aaron L Lembo

(74) *Attorney, Agent, or Firm* — Matthews, Lawson, McCutcheon & Joseph, PLLC

(57) ABSTRACT

A setting tool for deploying a downhole tool within a wellbore is described herein. The setting tool uses an in situ non-explosive gas-generating power source to generate high-pressure gas, which drives a mechanical linkage to actuate the deployment of the downhole tool. According to certain embodiments the non-explosive gas-generating setting tool contains no hydraulic stages and may contain only a single piston. The setting tool may be fitted to provide different stroke lengths and can provide usable power over a greater percentage of its stroke length, compared to setting tools using explosive/pyrotechnic power sources. Methods of using a non-explosive gas-generating setting tool to deploy a downhole tool within a wellbore are also disclosed.

13 Claims, 8 Drawing Sheets

(56) References Cited

U.S. PATENT DOCUMENTS

| | | | | |
|---|---|---|---|---|
| 8,196,515 | B2 | 6/2012 | Streibich | |
| 8,474,381 | B2 | 7/2013 | Streibich | |
| 8,534,367 | B2 | 9/2013 | Carisella | |
| 8,752,488 | B2 | 6/2014 | Streibich | |
| 8,893,786 | B2 | 11/2014 | Wright | |
| 9,234,412 | B2 * | 1/2016 | Getzlaf | E21B 43/12 |
| 9,580,975 | B2 * | 2/2017 | Carlsen | E21B 19/002 |
| 2005/0247450 | A1 | 11/2005 | Ratanasirigulchai et al. | |
| 2011/0132223 | A1 | 6/2011 | Streibich | |
| 2011/0174504 | A1 | 6/2011 | Wright | |
| 2012/0216701 | A1 | 8/2012 | Streibich | |
| 2013/0068451 | A1 | 3/2013 | Getzlaf | |
| 2014/0137761 | A1 | 5/2014 | Robertson | |
| 2016/0130903 | A1 | 5/2016 | Robertson | |
| 2016/0168936 | A1 * | 6/2016 | Carisella | E21B 23/04 166/381 |
| 2016/0369597 | A1 | 12/2016 | Robertson | |
| 2017/0067305 | A1 | 3/2017 | Robertson | |

* cited by examiner

SETTING TOOL FOR DOWNHOLE APPLICATIONS

CROSS REFERENCE TO RELATED APPLICATIONS

The present application is a continuation of U.S. Non-provisional application Ser. No. 14/930,369, entitled "Setting Tool For Downhole Applications," filed on Nov. 2, 2015, which claims priority to U.S. Provisional Application Ser. No. 62/073,704, entitled "Setting Tool For Downhole Applications, filed Oct. 31, 2014, and which is a continuation-in-part of U.S. patent application having patent application Ser. No. 13/507,732, entitled "Permanent Or Removable Positioning Apparatus And Methods For Downhole Tool Operations," filed Jul. 24, 2012, all of which are hereby incorporated by reference in their entireties herein.

FIELD OF THE INVENTION

The present invention relates, generally, to the field of downhole tools and methods of setting such downhole tools within a well bore. More particularly, the embodiments of the present invention relate to a non-explosive, gas-generating setting tool usable for downhole applications.

BACKGROUND

Many wellbore operations necessitate anchoring a tool within the wellbore. Such tools can include plugs, packers, hangers, casing patches, and the like (collectively referred to herein as downhole tools).

FIG. 1 illustrates a common mechanism for anchoring a downhole tool 100 in a wellbore 101. Wellbore 101 includes a tubular member 102 having an inner diameter (ID) 103. Tubular member 102 may be production tubing, casing, production liner or any other structure defining the walls of a wellbore. Wellbore 101 is illustrated as being substantially larger in diameter than downhole tool 100, but this is for illustration purposes only. Generally, the downhole tool 101 would have a diameter only slightly smaller than ID 103 of tubular member 102.

Downhole tool 100 includes a mandrel 104 having cone-shaped protrusions 105 and 106 and a sealing section 107. Cone-shaped protrusions 105 and 106 can slide over the mandrel 104 and make contact with sealing section 107 via surfaces 108 and 109, respectively. Sealing section 107 is typically made of a deformable or otherwise malleable material, such as plastic, metal, an elastomer or the like.

Downhole tool 100 further includes a base section 110 attached to the mandrel 104 via a threaded section 111. Base section 110 can apply pressure to cone-shaped protrusion 105 via slips 112 when the mandrel 104 is moved in an upward direction 113. Cone-shaped protrusion 105 consequently slides up and over the mandrel 104, applying pressure to the sealing section 107. Downward pressure 114 to slips 115 (usually exerted by a sleeve 120) likewise transfers pressure to the sealing member 107 as the cone-shaped protrusion 106 slides downward. Sealing member 107 deforms and expands due to lateral pressure 116 (with force line indicated), as the sealing member 107 is squeezed between the cone-shaped protrusions 105 and 106. Ultimately, the sealing member expands to form a seal with the ID 103 of tubular member 102.

Once the lateral pressure 116 of the sealing member 107 against the ID 103 exceeds a certain calibrated value, continued squeezing (i.e., 113 and 114) causes the slips 112 and 115 to ride up on the cone-shaped protrusions 105 and 106, respectively. Slips 112 and 115 are also commonly referred to in the art as "dogs." Upwardly stroking of the bottom dog (i.e., slip 112) causes the dog to ride up the cone-shaped protrusion 105 and to deform outwardly, indicated by the illustrated force arrow 117. Ultimately, the dog (i.e., slip) 112 will deform outwardly enough that the teeth 112*a* of the dog (i.e., slip) will bite into the ID 103. Likewise, continued downward pressure 114 on the slip 115 will cause the slip 115 to deform outwardly (indicated by the illustrated force arrow 118). Thus, downwardly stroking the top dog (top slip 115) causes it to bite into the ID 103 with teeth 115*a*. In the deployed configuration, the downhole tool 100 is anchored within the wellbore 101 by lateral pressure of the sealing section 107 and by the friction of the slips 112 and 115 biting into the ID 103 (via teeth 112*a* and 115*a*, respectively).

Tools, such as the generic downhole tool 100, must be deployed within a wellbore using a setting tool. (Note the distinction between the term "setting tool" and the term "downhole tool." As used herein, a "setting tool" refers to a tool that is used to deploy a "downhole tool" within a wellbore). The setting tool carries the downhole tool 100 to the desired location within the wellbore and also actuates the mechanisms (e.g., applies forces 113 and 114) that anchor the downhole tool within the wellbore. To deploy a downhole tool within a wellbore, a setting tool is typically connected to the downhole tool and the pair of tools (i.e., setting tool and downhole tool) is run down the wellbore using a slickline, coiled tubing, or other conveying method. Once the pair of tools reaches the desired depth within the wellbore, the setting tool deploys the downhole tool by actuating the forces described above.

A variety of types of setting tools that operate according to a variety of designs are known in the art. Setting tools differ from one another with regard to the method by which they produce the output needed to actuate the downhole tools and, consequently, the amount of force they are capable of producing. Examples of force generating methods include hydraulic, electromechanical, mechanical, and pyrotechnic (explosive) methods.

Each type of setting tool has associated advantages and disadvantages. For example, a disadvantage of hydraulic setting tools is that they generally require that fluid be pumped to the tool from the surface to pressurize and actuate the tool's setting mechanisms. By contrast, a pyrotechnic-based setting tool may be actuated using a timer or condition sensor that is contained within the setting tool itself, allowing the setting tool to operate without communicating with the surface to activate the setting tool. Examples of condition sensors include sensors that monitor acceleration, hydrostatic pressure, temperature, or a combination of these or other conditions. Once the requisite programmed conditions are met, a detonator within the setting tool can activate, and deploy the downhole tool, without needing to receive instructions from the surface.

Pyrotechnic-based setting tools have several problems. One problem is that the highly explosive materials they require to operate are generally dangerous and are typically subject to import/export and travel restrictions. Also, the setting tool can remain pressurized following detonation and must be depressurized by bleeding off pressure from the tool, by rupturing a bleed off mechanism at the surface—an operation that can be hazardous. Still further, and as explained in more detail below, pyrotechnic-type setting tools produce pressure in an explosive manner. The impulse generated by the rapid expansion of gases upon detonation in such a setting tool may not generate the optimum pressure for deploying downhole tools. Basically, the explosion may generate too much over pressure, over too short of a time, to properly set the downhole tool. Consequently, the force of the explosion must be throttled or dampened-a function typically performed using an internal hydraulic transducing mechanism. But such tools are limited in their application because they can only produce adequate force over short distances.

Accordingly, there remains a need in the art for a more versatile setting tool.

SUMMARY

The present invention relates to a non-explosive, gas-generating setting tool usable for setting downhole tools, such as a include a packer, a bridge plug, a fracturing plug, or other similar downhole tools, within a well bore.

The embodiments of the present invention include a well tool that can include a chamber comprising side walls and an activator disposed at a first end of the chamber. The chamber can be configured to contain a non-explosive gas and plasma-generating fuel, and a liner can be configured to protect the side walls of the chamber from the plasma of the non-explosive gas and the plasma-generating fuel. The well tool can further include a tool body that can comprise a cavity configured to receive pressure from the chamber, a bleed sub that can be positioned between the chamber and the tool body and configured to control pressure from the chamber as it is applied to the cavity, and a piston that is disposed within the cavity and oriented to stroke in a first direction in response to a pressure increase in the cavity. The piston can be mechanically connected to a shaft that can stroke in the first direction, with the piston, in response to the pressure increase in the cavity. The mechanical connection between the piston and the shaft creates a linkage between the two such that the actuation of the piston causes the actuation of the shaft and vice versa. The embodiments of the well tool are configured so that pressurizing the chamber, by activation of the non-explosive gas and plasma-generating fuel, can cause the piston and shaft to stroke.

In an embodiment, the well tool comprises a mechanical linkage between the shaft and an extendable sleeve, wherein the extendable sleeve is configured to actuate when the shaft is stroked in the first direction.

In an embodiment, the well tool can comprise a mandrel, which can be configured to receive the shaft when the shaft is stroked in the first direction. The mandrel can comprise a slot having a cross member disposed therein, and the cross member can be pushed by the shaft when the shaft is stroked in the first direction.

In an embodiment, the shaft, which is connected to the piston, can configured so that the shaft is a first shaft that can be exchanged for a second shaft of a different length than the first shaft. In an embodiment, the second shaft can be at least twice as long as the first shaft.

The well tool comprises a non-explosive gas and a plasma generating fuel, which can comprise a quantity of thermite that is sufficient to generate a thermite reaction when heated in excess of an ignition temperature, and a polymer that is disposed in association with the thermite. The polymer can produce a gas when the thermite reaction occurs, wherein the gas slows the thermite reaction, and wherein pressure is produced by the thermite reaction, the gas, or the combinations thereof.

In an embodiment of the present invention, the well tool further comprises a compressible member that can be configured in relationship with the shaft, such that the compressible member is compressed by the piston when the piston is stroked in the first direction, thereby decelerating the piston and shaft.

In an embodiment of the well tool, the tool body comprises a first inside diameter and a second inside diameter longitudinally disposed with respect to the first inside diameter, wherein the second inside diameter can be greater than the first inside diameter. One or more o-rings can be disposed upon the piston to form a gas-tight seal between the piston and the first inside diameter. In an embodiment, when the piston strokes in the first direction from the first inside diameter to the second inside diameter, the one or more o-rings do not form a gas-tight seal between the piston and the second inside diameter.

In an embodiment of the present invention, the well tool further comprises a shaft sub, wherein the shaft can slide through the shaft sub in the first direction when stroked, and one or more o-rings can be disposed within the shaft sub to form a gas-tight seal between the shaft sub and the shaft. In an alternate embodiment, the shaft can comprise a fluted section, wherein the intersection between the fluted section and the shaft sub can prevent one or more o-rings from forming a gas-tight seal between the shaft sub and the shaft.

In an embodiment of the well tool, a bleed sub is disposed between the chamber and the piston, and the bleed sub comprises a carbon-containing disk member that is configured to protect components of the bleed sub from gases generated within the chamber. The carbon disk of the bleed sub can be punctured to relieve pressure in the setting tool as needed, which is generally caused from the excitation or increased pressurization of gases within the setting tool.

Embodiments of the present invention include a self-bleeding well tool that comprises a tubular tool body, which can include a first inside diameter and a second inside diameter, wherein the second inside diameter can be greater than the first inside diameter, and a piston, which can comprise one or more o-rings about the piston's circumference and wherein the piston can be configured to stroke from a first position to a second position within the tubular tool body in a first direction. The one or more o-rings can form a gas-tight seal, with the first inside diameter, when the piston is positioned at the first position within the first inside diameter. Alternatively, the one or more o-rings do not form a gas-tight seal with the second inside diameter when the piston is positioned at the second position within the second inside diameter.

In an embodiment, the self-bleeding well tool further comprises a shaft that is mechanically connected to the piston and configured to stroke from the first position to the second position within the tubular tool body, in a first direction.

In an embodiment, the self-bleeding well tool further comprises a shaft sub, wherein the shaft can slide through the shaft sub when stroking from the first position to the second position, and one or more o-rings can be disposed within the shaft sub to form a gas-tight seal between the shaft sub and the shaft. In an embodiment of the self-bleeding well tool, the shaft can comprise a fluted section, and the intersection between the fluted section and the shaft sub can prevent the one or more o-rings from forming a gas-tight seal between the shaft sub and the shaft.

Embodiments of the present invention can include a modular well tool kit, which comprises a chamber that includes side walls, an activator disposed at a first end of the chamber, and a non-explosive gas and plasma-generating fuel disposed within the chamber. The modular well tool kit can further comprise a first tool body, which can include a cavity that is configured to receive pressure from the chamber and to contain a piston mechanically connected to one shaft of at least two interchangeable shafts.

The at least two interchangeable shafts can be of similar or different lengths. In an embodiment, each shaft, of the at least two interchangeable shafts, can be configured to mechanically connect to the piston and to stroke within the first tool body when the first tool body is operably connected with the chamber. In an embodiment, the modular well tool kit can further comprise a second tool body, wherein the exchanging of one shaft of the at least two interchangeable shafts for another of the at least two interchangeable shafts can comprise exchanging the second tool body for the first tool body.

The embodiments of the present invention can include a method of deploying a downhole tool within a wellbore that includes the steps of activating a non-explosive gas and plasma-generating fuel, which are contained within a chamber of a setting tool that is operatively connected to the downhole tool, and directing the non-explosive gas within the chamber to impinge directly on a piston. The downhole tool can include a packer, a bridge plug, a fracturing plug, or similar tools. The steps of the method can continue by actuating the piston to stroke within a tubular tool body, and mechanically actuating a setting mechanism of the downhole tool with the piston, wherein the plasma can be blocked from impinging on the piston by a filtering plug.

In an embodiment, the non-explosive gas and plasma-generating fuel can comprise a quantity of thermite, which can be sufficient to generate a thermite reaction. In an embodiment, the non-explosive gas and plasma-generating fuel can comprise a polymer. The polymer can be disposed in association with the thermite, and the polymer can produce a gas when the thermite reaction occurs, wherein the produced gas can slow the thermite reaction, such that pressure is produced by the thermite reaction, the gas, or the combinations thereof.

In an embodiment, the step of mechanically actuating the setting mechanism can further comprise pushing a shaft that is mechanically linked to an extendable sleeve to actuate the setting mechanism of the downhole tool. In an embodiment, the shaft can be usable for pushing a crosslink key, which is disposed within a slot of a mandrel and mechanically linked to the extendable sleeve, for mechanically actuating the setting mechanism.

In an embodiment, the step of mechanically actuating the setting mechanism can comprise multiple sequential stages, wherein each sequential stage is essentially completed before the next sequential stage begins. The stages can comprise one or more of anchoring a bottom set of slips to an inner diameter of a tubular with the wellbore, compressing a sealing section to form a seal between the downhole tool and the inner diameter of the tubular, anchoring a top set of slips to an inner diameter of the tubular, and/or shearing a shear stud.

DESCRIPTION

Before describing selected embodiments of the present disclosure in detail, it is to be understood that the present invention is not limited to the particular embodiments described herein. The disclosure and description herein is illustrative and explanatory of one or more presently embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 2:
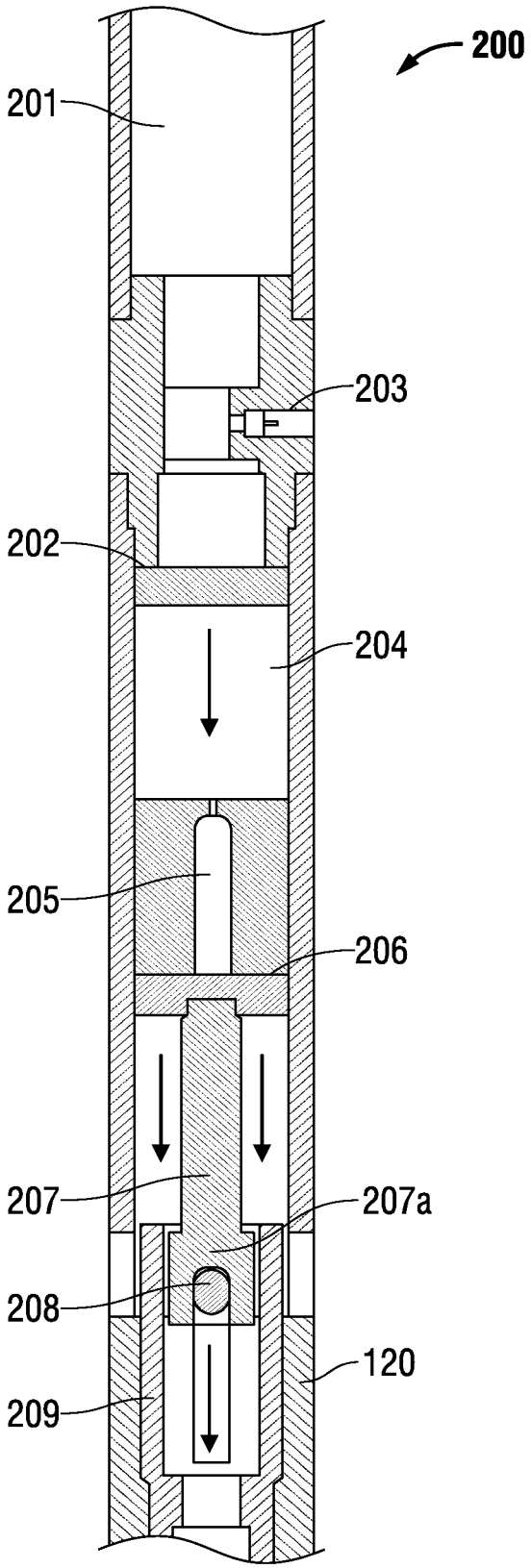
FIG. 2 illustrates an explosive-based setting tool.

FIG. 2 illustrates a pyrotechnic-based setting tool 200. Note that the purpose of FIG. 2 is to illustrate how an explosive-based setting tool 200 operates and not to provide a comprehensive disclosure of that type of setting tool. As such, details of the actual tool construction, for example, o-rings, connectors, seals and the like, are omitted for clarity.

Pyrotechnic-based setting tool 200 includes a pressure chamber 201 that is in gas communication with a top piston 202. Pressure chamber 201 is configured to contain an explosive power charge that provides the power that drives piston 202 of the setting tool 200. The explosive power charge is typically ignited using an igniter contained in an isolation sub disposed upward of the pressure chamber 201. Pressure chamber 201 is typically configured with a bleed off valve 203 for bleeding off gases after the tool has been used and is returned to the surface of the wellbore.

Upon ignition, rapidly expanding gases exert pressure on the top piston 202, which in turn compresses hydraulic fluid that is contained within reservoir 204. The pressurized hydraulic fluid, which is choked somewhat by a cylindrical connector 205, applies pressure to a bottom piston 206. As the bottom piston is pressurized, it moves in a downhole direction, bringing with it a piston rod 207. Head 207*a* of the piston rod 207 is configured with a crosslink key 208. As the piston rod 207 strokes downward, the crosslink key 208 engages and pushes a sleeve 120 that is configured upon a setting mandrel 209. Although not shown, the setting mandrel 209 can be temporarily affixed to the mandrel 104 of the downhole tool 101, typically via a shear pin. The sleeve 120 applies downward pressure 114 to the slips 115 of the downhole tool 100 (not shown here, but depicted in FIG. 1), while affixation of the mandrels 209 and 104 creates an equal upward pressure 113 to the slips 112. This actuates the setting mechanism of the downhole tool, as described earlier. Once the tool 100 is set in the tubular member 102, tools 200 and 100 can be decoupled (typically by shearing the shear pin that holds them together), leaving the downhole tool 100 in place.

As mentioned previously, the rapid expansion of gases and pressurization within the setting tool upon detonation requires that the generated pressure be throttled back and applied to the actuating mechanism (i.e., piston rod 207) in a controlled manner. That throttling function is performed by the hydraulic system, shown schematically as reservoir 204 and the cylindrical connector 205 of the setting tool 200.

The inventors have discovered that by using a non-explosive gas-generating material as the power source, the benefits of a pyrotechnic-type setting tool can be realized, but without the associated drawbacks. Namely, the setting tool described herein does not require a hydraulic damping system to transfer power from the power source to the actuating mechanism. Also, the non-explosive gas-generating material is safer to handle and transport and generally does not require the same shipping and import/export controls as do the explosive materials used with pyrotechnic-type setting tools. Easier transporting and shipping requirement is valuable; it can result in a setting tool being available at a well-site within a day or two, as opposed to within a week or two-a difference that can equate to hundreds of thousands of dollars to the well owner.

Figure 3A:
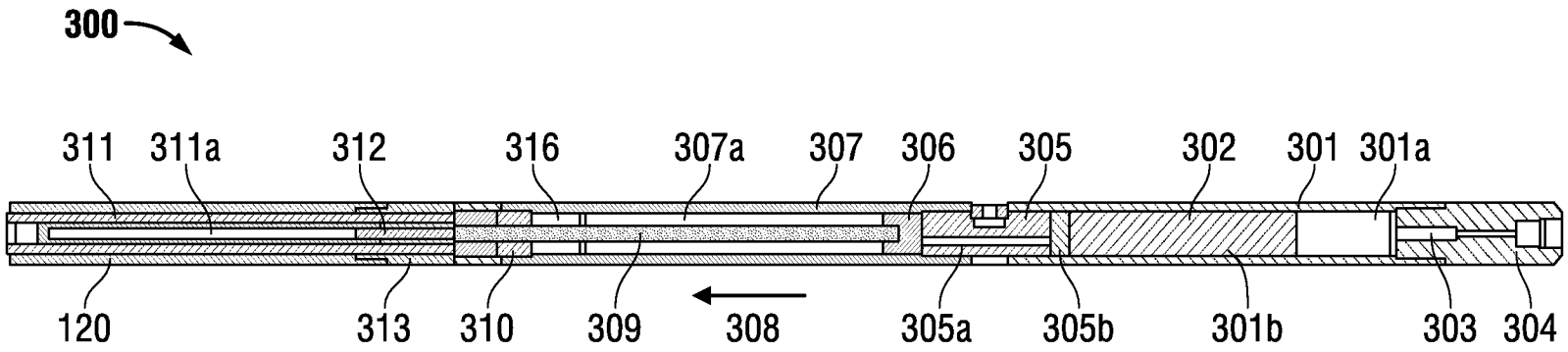
FIGS. 3A and 3B illustrate a non-explosive gas-generating setting tool in the pre-function and post-function configuration, respectively.
Figure 3B:
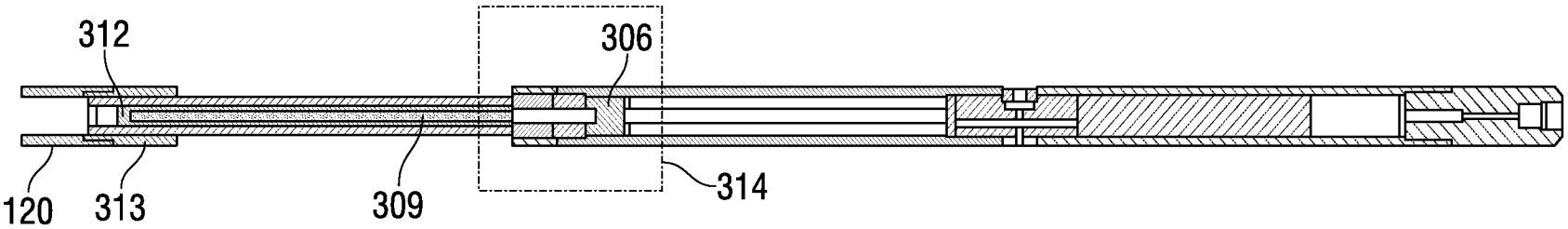

FIGS. 3A and 3B illustrate an embodiment of a non-explosive gas-generating setting tool 300 in the pre-function and post-function configuration, respectively. For purposes of clarity, some elements of the non-explosive gas-generating setting tool 300 that are labeled in FIG. 3A are not re-labeled in FIG. 3B.

Non-explosive gas-generating setting tool 300 includes a power source body 301 that contains a power source 302. Power source 302 is capable of producing gas in an amount and at a rate sufficient to operate the non-explosive gas-generating setting tool 300.

Power source 302 is referred to as an "in situ" power source, meaning that it is contained within the setting tool downhole during operation. The in situ power source can be activated from the surface, via wireline, for example, or may be activated using a timer or sensor downhole.

As used herein, the term "power source" refers to a non-explosive gas-generating source of gas. Examples of suitable power source materials and construction are described in U.S. Pat. No. 8,474,381, issued Jul. 2, 2013, the entire contents of which are hereby incorporated herein by reference. Power source materials typically utilize thermite or a modified thermite mixture. The mixture can include a powdered (or finely divided) metal and a powdered metal oxide. The powdered metal can be aluminum, magnesium, etc. The metal oxide can include cupric oxide, iron oxide, etc. A particular example of thermite mixture is cupric oxide and aluminum. When ignited, the flammable material produces an exothermic reaction. The material may also contain one or more gasifying compounds, such as one or more hydrocarbon or fluorocarbon compounds, particularly polymers.

Power source 302 can be activated (ignited) using an activator 303 contained within an isolation sub 304. Examples of suitable activators include Series 100/200/300/700 Thermal Generators™ available from MCR Oil Tools, LLC, located in Arlington, Tex.

Once activated, the power source 302 generates gas, which expands and fills a chamber 301*a* of the power source body 301. The chamber 301*a* may be protected by a coating or liner 301*b* that is resistant to high temperatures that the power source 302 may reach as the gas expands. The liner 301*b* may also include a ceramic coating that is painted into the chamber 301*a* during manufacture. The liner 301*b* may also include a carbon sleeve into which the power source 302 is inserted as the setting tool 300 is prepared for operation at the surface of the well. The liner 301*b* may include other materials such as PVC, plastic, polymers, and rubber. The liner 301*b* enables a broader range of materials to be used for construction of the power source body 301. For example, without the liner 301*b*, the power source body 301 would be restricted to materials that did not corrode, melt, or otherwise react with the power source 302 and the resulting high temperature gases.

The gas expands via a conduit 305*a* of a bleed sub 305 and applies pressure to a piston 306, which is contained within a tool body 307. To protect the conduit 305*a*, the power source body 301 may also include a filtering plug 305*b* to filter the expanding gases from the solid particulates that are also produced by the power source 302. When the power source 302 is activated, the solid fuel is rapidly transformed into gases that power a reaction, as explained in detail below. In addition to these gases, however, the power source 302 may also include hot plasma or solids that can burn or otherwise damage the components of the setting tool 300. The filtering plug 305*b* may comprise a graphite disk or block with a number of holes that are sized to allow gases to pass through without allowing the plasma or solids to pass through. The gases that are allowed to pass through are not as damaging to the bleed sub 305 or the tool body 307 as the plasma or burning solids.

Under pressure produced by the expansion of gases from the power source 302, the piston 306 moves (i.e. strokes) in the direction indicated by arrow 308. As piston 306 moves, it pushes a shaft 309, which is connected to the tool body 307 via a shaft sub 310. The shaft 309 strokes within a mandrel 311, pushing a crosslink key 312 that is set in a slot 311*a* within the mandrel 311. Crosslink key 312 is configured to engage a crosslink adapter 313 and an extension sleeve 120. The crosslink key 312 pushes the crosslink adapter 313 and the extension sleeve 120, causing the sleeve to apply the actuating force (113, 114) to deploy a downhole tool. Piston 306, shaft 309, crosslink key 312 and sleeve 120 are therefore a power transfer system that delivers force generated by the combustion of the power source 303 to actuate/deploy a downhole tool.

Embodiments of non-explosive gas-generating setting tool 300 may include a snubber 316, which is a compressible member configured to be impacted by the piston 306 as the piston completes its stroke, thereby decelerating the piston stroke and dissipating energy from the piston and shaft. Snubber 316 is configured upon the shaft 309 and within tool body 307 and is made of a compressible material, for example, a polymer, plastic, PEEK™, Viton™, or a crushable metal, such as aluminum, brass, etc. The controlled deformation of snubber 316 decelerates the moving piston 306 and shaft 309, absorbing energy in the traveling sub assembly and preventing damage due to rapid deceleration. The material of the snubber 316 may be chosen to adjust the deceleration and provide differing values of energy damping based on tools size, setting force, etc. Should additional damping be required, the cavity 307*a* within the tool body 307 can be pressurized with a secondary gas to provide additional resistance to the motion of the piston 306. Accordingly, the tool body 307 may be fitted with a valve (not shown) for introducing such pressurized gas.

Several differences between the setting tool, illustrated in FIG. 2, and the embodiment of the non-explosive gas-generating setting tool 300 illustrated in FIG. 3 should be noted. One difference is the non-explosive gas-generating setting tool 300 has a mechanical linkage between the piston 306 (i.e., the piston directly activated by pressurization of power source body 301) and the extension sleeve that ultimately deploys the downhole tool. In other words, there is not an intervening hydraulic or pneumatic stage comparable to the reservoir 204 and choke met by top piston 202 in FIG. 2. Stroking of the piston 306 and shaft 309 mechanically actuates the extension sleeve by pushing one or more rigid members (i.e., crosslink key 312 and crosslink adapter 313).

In addition, embodiments of non-explosive gas-generating setting tool 300 can include only a single piston/shaft, wherein the shaft is mechanically connected to the piston, and as such, the non-explosive gas-generating setting tool 300 does not require multiple pistons (202, 206) to achieve a long stroke length. As used herein, the term stroke length refers to the length over which useful force can be applied, as explained in more detail below.

Non-explosive gas-generating setting tool 300 features two mechanisms for bleeding off gases that are generated during the ignition of the power source 302. The first bleed off feature 314 (FIG. 3B), is referred to herein as a self-bleed feature and is illustrated in greater detail in FIG. 4. The second bleed off feature is provided by the bleed sub 305 (FIG. 3A) and is illustrated in more detail in FIG. 5, discussed below.

Figure 4:
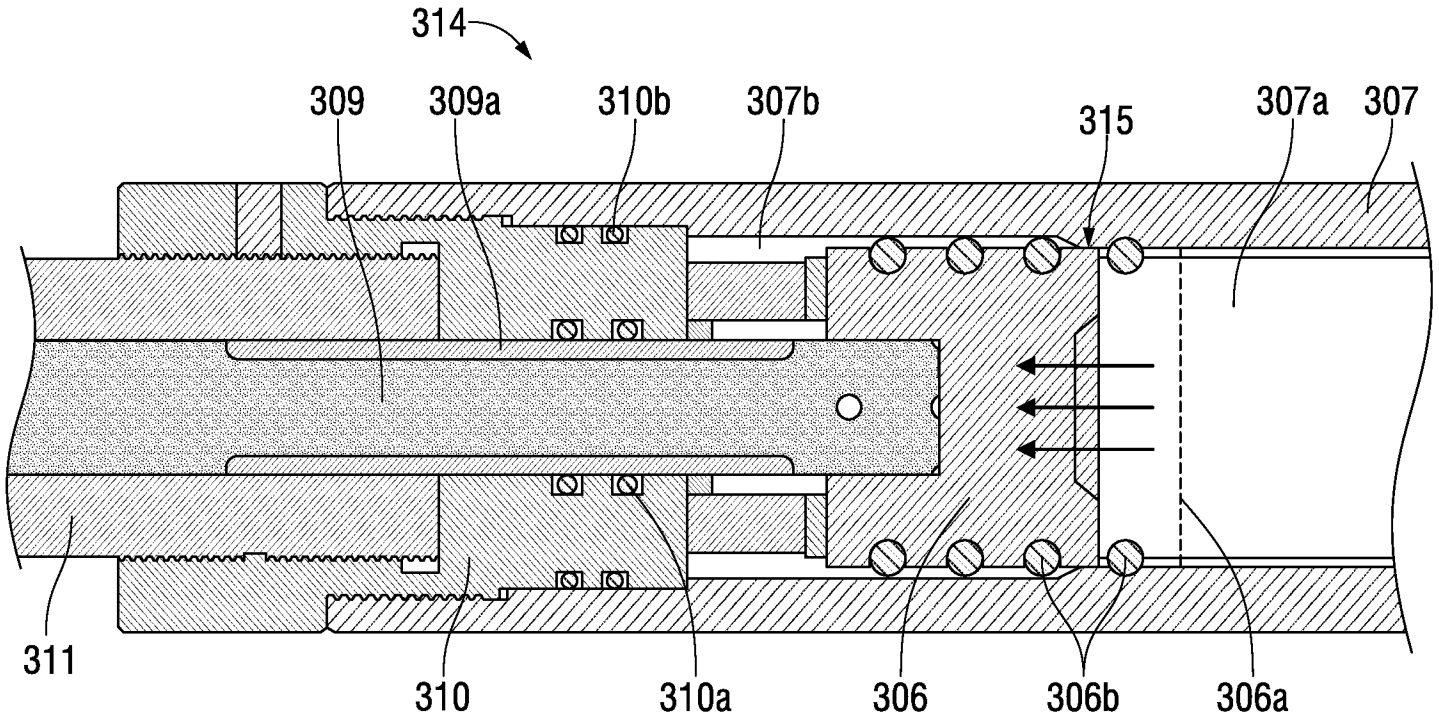
FIG. 4 illustrates a self-bleed mechanism for a non-explosive gas-generating setting tool.

Referring to FIG. 4, dashed line 306*a* represents the position of the piston 306 before it has completed its stroke. In this intermediate position, piston o-rings (illustrated as hatched o-rings 306*b*) can form a gas-tight seal with the ID of the tool body 307. The ID of tool body 307 is configured with a spacer 307*b* between its ID and the piston 306 once the piston 306 has completed its stroke. Because of the spacer 3076, the piston o-rings 306*b* do not form a gas-tight seal with the ID of the tool body 307 once the piston stroke is completed, as FIG. 4 shows. Instead, the area of contact 315 between the piston 306 and the ID of the tool body 307 allows gas to pass between the chamber 307*a* and the spacer 3076. Stated slightly differently, as the piston 306 strokes within the tubular tool body 307, the piston travels from a section the of tool body having a smaller ID into a section of the tool body 307 having a larger ID. When the piston 306 is within the section with the smaller ID, the o-rings are capable of forming a gas-tight seal between the piston and the ID. But when the piston 306 is within the section with the larger ID, the o-rings 306*b* are not capable of forming such a gas seal.

Shaft sub 310 also includes o-rings 310*a*, which are capable of forming a gas-tight seal between the shaft 309 and the shaft sub 310 along the initial majority of its length. However, the proximal end of the shaft 309 can be configured with a fluted section having flutes 309*a*, which prevent the shaft sub o-rings 310*a* from forming a gas-tight seal between the shaft sub 310 and the shaft 309 when the shaft 309 nears completion of its stroke. Thus, at the end of the stroke, gas overpressure within the chamber 307*a* has a conduit (i.e., an "escape route") by which to bleed into the wellbore by first escaping into the spacer 3076 through the area of contact 315 and then into the wellbore through the flutes 309*a*.

Figure 5:
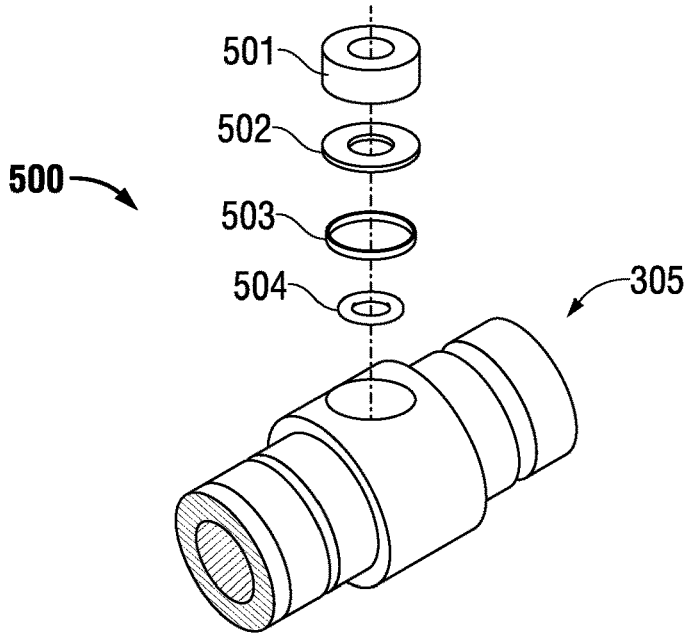
FIG. 5 illustrates a manual bleed sub for a non-explosive gas-generating setting tool.

FIG. 5 illustrates the bleed sub 305 and related sealing components 500, in detail. Manual bleed off mechanisms, such as the one illustrated in FIG. 5, are known in the art and generally include a nut 501, a pressure bleed off disk 502, and one or more o-rings or seals 503. However, bleed sub 305 includes an additional component-a carbon disk 504, to protect the scaling components 500 from gases generated during the activation of the power source. Should the self-bleed mechanism fail to adequately bleed off the pressurized gases, the bleed off disk 502 and the carbon disk 504 can be punctured to relieve the pressure in the setting tool once it is retrieved at the surface.

Figure 6:
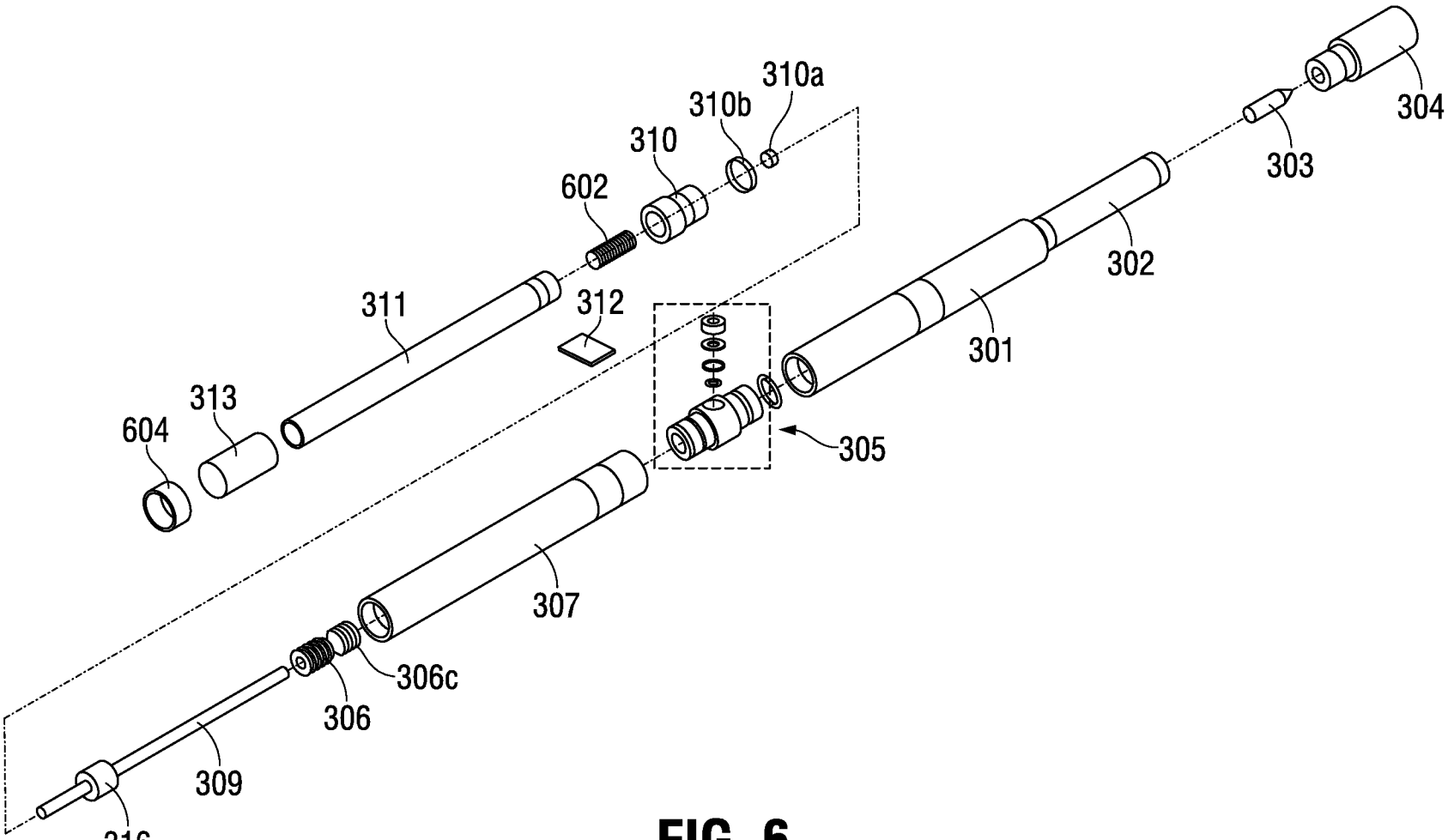
FIG. 6 is an exploded view of a non-explosive gas-generating setting tool.

FIG. 6 illustrates an exploded view of the non-explosive gas-generating setting tool 300, showing the interrelationship of the following components, which have been discussed above: power source body 301, power source 302, activator 303, isolation sub 304, bleed sub 305, piston 306, piston o-rings 306*c*, tool body 307, shaft 309, shaft sub 310, shaft sub o-rings 310*a* and 310*b*, mandrel 311, snubber 316, crosslink key 312, crosslink adapter 313, crosslink coupler 602 and crosslink retainer 604.

Figure 1:
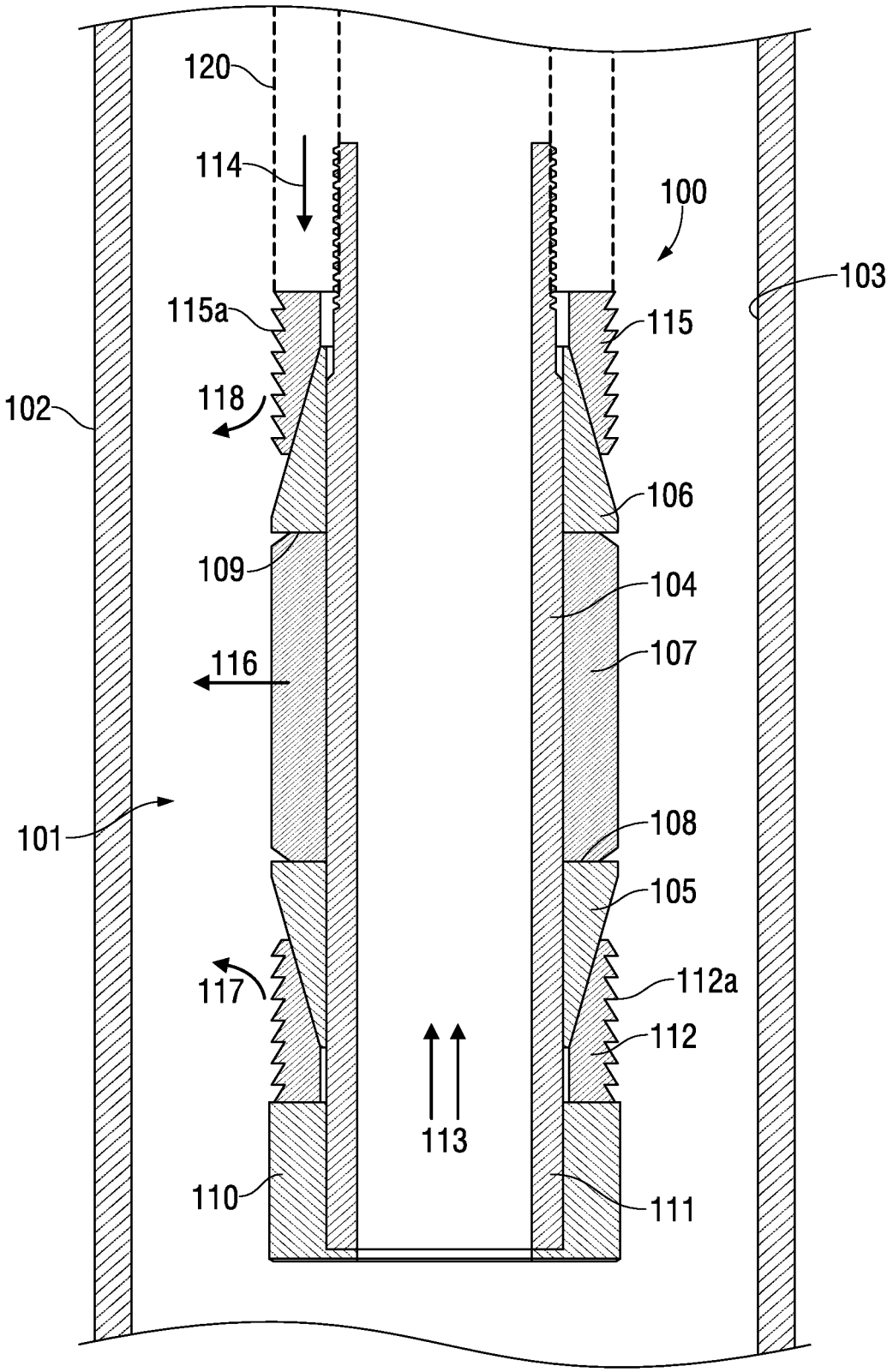
FIG. 1 illustrates a downhole tool according to the existing art.

To deploy a typical downhole tool, such as the downhole tool 100 illustrated in FIG. 1, a setting tool must generate enough force and must provide a long enough stroke to actuate the setting mechanism of the downhole tool 100. Actuating the setting mechanism might include moving the cone-shaped protrusions 105 and 106, compressing and laterally expanding the sealing section 107, setting the slips 112 and 115 and shearing off a shear pin that attaches the downhole tool to the setting tool. The amount of force required to perform all of those tasks is referred to as shear force ($F_s$) because deploying a downhole tool typically culminates in shearing a shear pin to leave the tool in place. The stroke required to actuate the downhole tool is referred to as the required stroke length. The setting tool must also provide adequate force to overcome the hydrostatic pressure within the wellbore 101 at whatever depth within the wellbore the downhole tool is located.

Setting tools are often characterized according to their rated shear forces and stroke lengths. For example, an operator might need to deploy a downhole tool that requires a shear force of 9,000 kg (20,000 pounds) and a stroke length of 30 cm (12 inches). That operator would look for setting tool that is rated to provide 9,000 kg (20,000 pounds) of force at a stroke length of 30 cm (12 inches) at the particular hydrostatic pressure present at the depth within the wellbore the operator intends to deploy the tool. Standard rated stroke lengths may vary; examples values may comprise about 15, 30, 45, or 60 cm (6, 12, 18, or 24 inches). Rated shear forces may comprise about 9,000, 11,333, 13,500, 18,000, 22,500, 25,000 or 29,000 kg (20,000, 25,000, 30,000, 40,000, 50,000, 55,000, or 60,000 pounds). Setting tools may be rated at hydrostatic pressures comprising about, 15,000, 20,000, 25,000, 30,000, 35,000, or 40,000 psi. A setting tool might be rated to provide 9,000 kg (20,000 pounds) of shear force at a 30 cm (12 inch) stroke length and at a hydrostatic pressure of 138 mPa (20,000 psi), for example. That same tool might not reliably provide 9,000 kg (20,000 pounds) of shear force if the hydrostatic pressure were increased to 172 mPa (25,000 psi) or if the stroke length were increased to 45 cm (18 inches).

Figure 7:
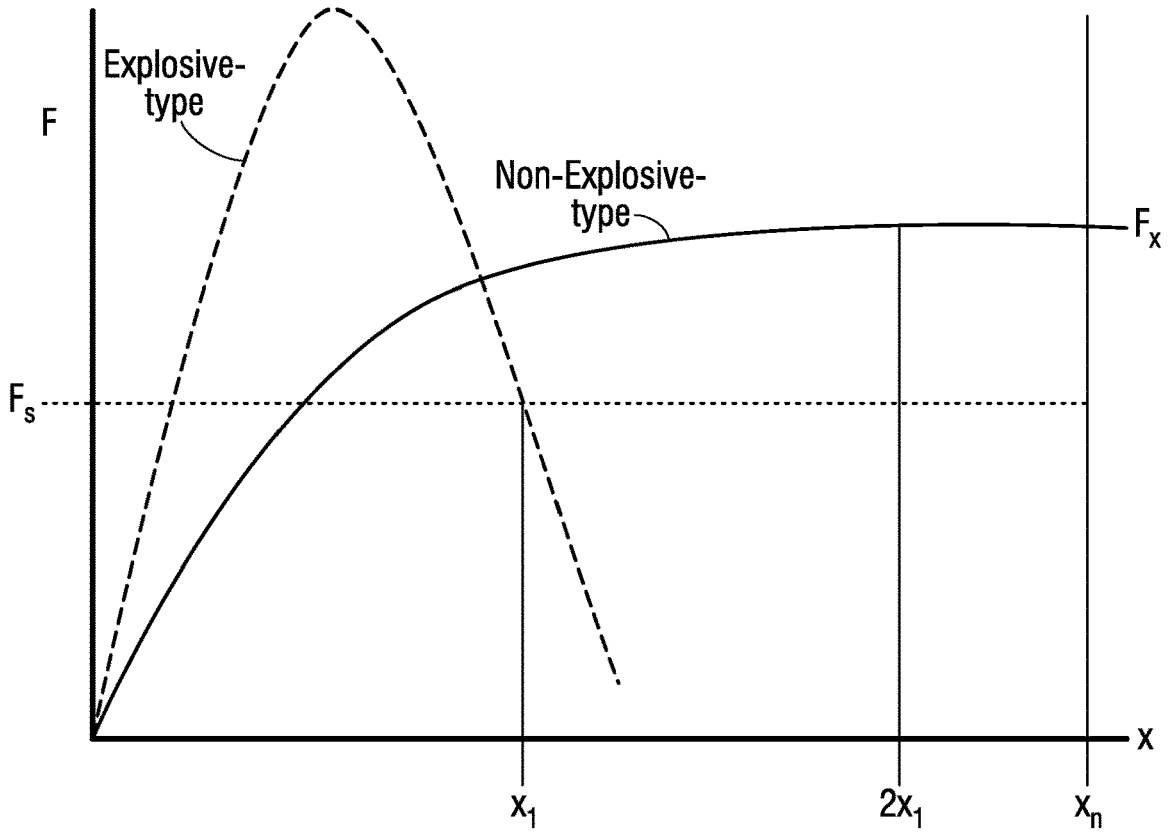
FIG. 7 illustrates a pressure curve for an explosive-type setting tool and a non-explosive gas-generating setting tool.

FIG. 7 compares the generated forces (F) for an explosive-type setting tool (dashed line) and a non-explosive gas-generating setting tool (solid lines) such as 300 (FIG. 3) as a function of stroke length (x). The tools depicted in FIG. 7 are both capable of delivering a shear force of Fs at a stroke length of $x_1$. In the following discussion, we will assume that $x_1$ is the rated stroke length, and Fs is the rated shear force at a particular hydrostatic pressure.

As shown in FIG. 7, the force delivered by the explosive-type setting tool falls off very quickly once the tool has stroked beyond its rated stroke length $x_1$. At a stroke length of twice the tool's rated stroke length (i.e., at $2x_1$), the explosive-type setting tool delivers essentially no force. By contrast, the non-explosive gas-generating setting tool delivers a substantial amount of force at a stroke length of $2x_1$. A characteristic of the non-explosive gas-generating setting tools described herein is that they can deliver a substantial fraction of their rated shear force at stroke lengths beyond their rated stroke length. Moreover, pressures provided by such tools preferably comprise at least 100%, 90%, 80%, 70%, 60% or 50% of their rated force at various multiples (one, two, three, etc.) of the standard stroke length.

The value $x_n$ in FIG. 7 is referred to as the maximum stroke length and may comprise the total distance crosslink keys 208 and 312 can travel before they reach a mechanical stop within tools 200 and 300, which is generally determined by the lengths of the tool body 307 and mandrel 311. As shown in FIG. 7, the non-explosive gas generating setting tool also supplies a greater amount of force over a greater percentage of the setting tool's maximum stroke length. According to certain embodiments, the non-explosive gas-generating setting tool may be capable of delivering at least about 75% of its maximum force at the maximum stroke length. According to still other embodiments, the non-explosive gas-generating setting tool may be capable of delivering at least about 85% of its maximum force at the maximum stroke length. According to still other embodiments, the non-explosive gas-generating setting tool may be capable of delivering at least about 95% of its maximum force at the maximum stroke length.

Figure 8:
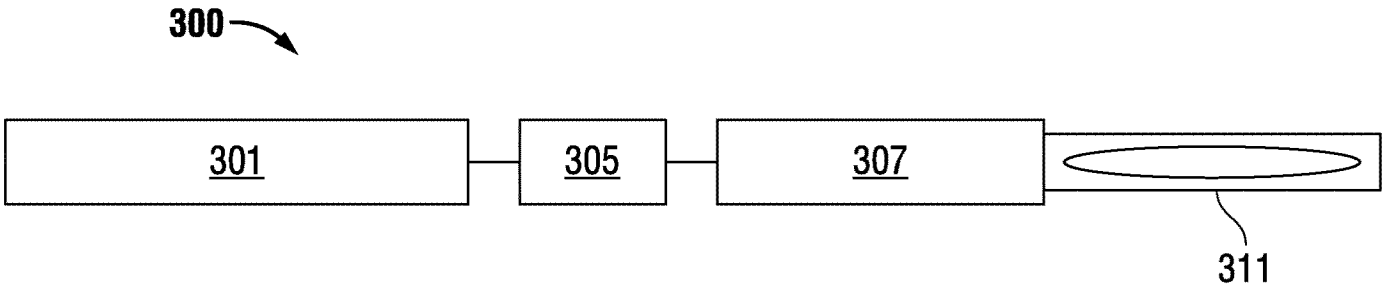
FIG. 8 illustrates embodiments of a non-explosive gas-generating fuel.

The ability to apply useful force over greater distances (greater standard stroke lengths) is advantageous because it significantly increases the versatility of the setting tool. FIG. 8 is a schematic illustration of the major sections of a non-explosive gas-generating setting tool 300, including the power stick body 301, bleed sub 305, tool body 307 and mandrel 311. Because the force generated by the non-explosive power stick 302 in the power stick body 301 is effective over a range of distances, that same power stick 302 can be used with different sizes of tool bodies 307 and mandrels 311, thereby providing different maximum stroke lengths, $x_n$, and different standard stroke lengths depending on the hydrostatic pressures at which it will be used. The non-explosive gas-generating setting tool 300 described herein can thus be provided as a modular kit containing a single (or limited number of) power source bodies 301, and a variety of sizes of tool bodies 307 and mandrels 308. Table 1 provides examples of modular tool combinations for providing different stroke lengths (metric values approximate).

TABLE 1

Modular Setting Tool Component Combinations.

| Power source Body 301 | Mandrel 311 | Rated Stroke Length | Maximum Stroke Length |
|---|---|---|---|
| 40 cm (16 in) | 40 cm (16 in) | 30 cm (12 in) | 40 cm (16 in) |
| 40 cm (16 in) | 70 cm (28 in) | 60 cm (24 in) | 70 cm (28 in) |
| 40 cm (16 in) or 70 cm (28 in) | 130 cm (52 in) | 120 cm (48 in) | 130 cm (52 in) |

The non-explosive gas-generating setting tool, because of its force curve as illustrated in FIG. 7, affords another advantage over explosive-type tools because its force is delivered in a controlled manner and not as an abrupt impulse. Such controlled delivery makes that force more useful. For example, a downhole tool 100 may be misaligned within the wellbore 101. If force is explosively delivered to the downhole tool (as illustrated in the dashed line of FIG. 7) when the downhole tool 100 is misaligned, the downhole tool may not seat properly, or worse yet, may seriously damage the wellbore 101. In contrast, force delivered non-explosively (as illustrated by the solid line of FIG. 7) can controllably push the downhole tool into alignment and then continue to apply pressure to set the downhole tool. In this regards, and while depending on the hydrostatic pressure, note that the stroke of the non-explosive gas generating setting tool can occur and provide useful force over a time period of several seconds to greater than a minute.

Moreover, some downhole tools benefit when setting pressure is sustained or increased during the stroke of the non-explosive gas generating setting tool. Referring again to the generic downhole tool illustrated in FIG. 1, setting of the downhole tool may be considered to proceed in stages. For example, the first stage may be the upward motion causing slips (i.e., dogs) 112 to grip ID 103 of the wellbore and provide static purchase. The second stage may be compressing the sealing section 107 to form a seal with ID 103. The third stage may be further compression, causing the slips 115 to bite into the ID 103. The fourth stage may be the shearing of the shear stud (not shown) to release the setting tool from the downhole tool.

The explosive application of pressure (as illustrated by the dashed line of FIG. 7) will simply "blow through" each of these stages, potentially leaving one or more of them incomplete and resulting on the shearing of the shear stud before the downhole tool is properly set. The non-explosive application of pressure (as illustrated by the solid line of FIG. 7), however, provides adequate time for each of the setting stages to complete in a sequential or cascading manner, resulting in optimum setting of the downhole tool.

The ability to deliver pressure in a sustained and/or increasing manner is due to the non-explosive generation of gas and also to the controlled rate at which that gas is produced. The gas production rate is a function of the burn rate of the material in the power source 302, which in turn is a function of the pressure within the power source body 301, as well as other factors, including temperature and the power source geometry (i.e., the burning surface area). To provide controllable increasing pressure, it can be beneficial to minimize changes in the variables that affect the burn rate so that the pressure within the power source body 301 is the primary determinant of the burn rate.

Figure 9F:
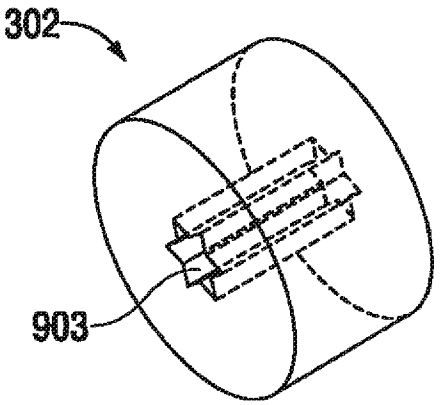
FIGS. 9A to 9F is-a are schematic illustrations of a modular non-explosive gas-generating setting tools.
Figure 9C:
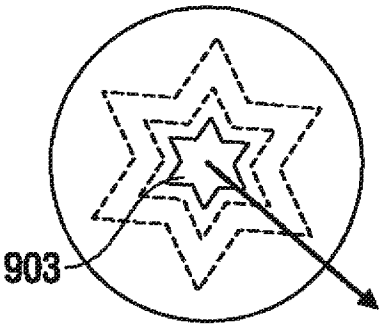
Figure 9E:
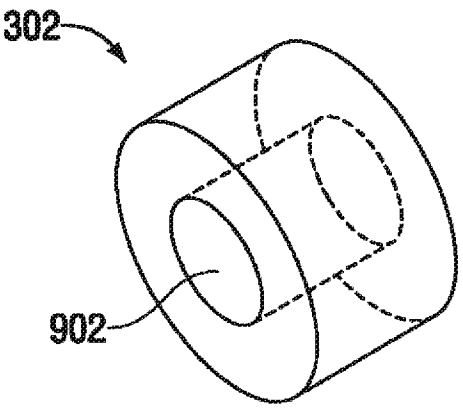
Figure 9B:
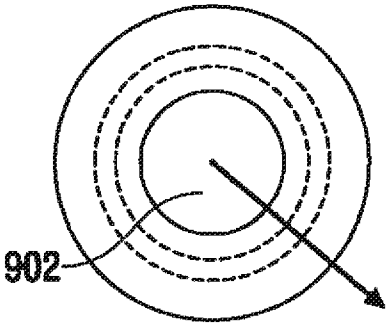
Figure 9D:
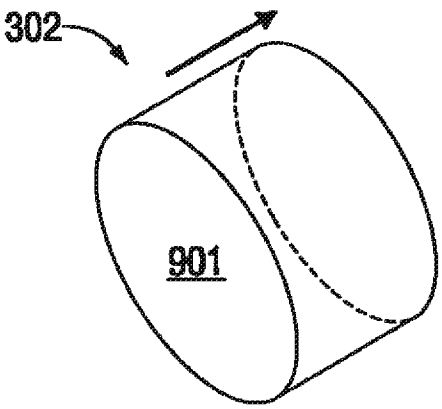
Figure 9A:
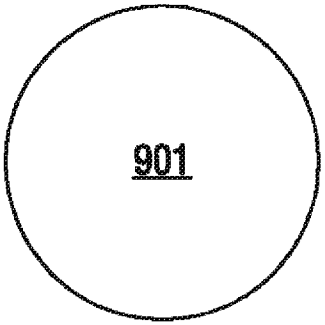

One way of minimizing changes in the burn rate due to changes in the burning surface area of the power source is to optimize the power source geometry so that the burning surface remains constant. FIGS. 9A to 9F illustrates three possible power source 302 geometries. FIGS. 9A and 9D depict is a simple cylinder, wherein burning proceeds from face 901 and burns along the cylinder, as indicated. The burning surface area 901 remains relatively constant as burning proceeds. Therefore, the geometry-dependence of burning rate is minimized with the geometry illustrated in FIGS. 9A and 9D. The power source illustrated in FIGS. 9B and 9E is provided with a hollow cylinder 902. Burning thus proceeds from inside out, as illustrated by the concentric circles of FIGS. 9B and 9E. As burning proceeds, the burning surface area, and hence the burn rate, increases. Likewise, the power source illustrated in FIGS. 9C and 9F is provided with a star-shaped cavity 903 running down its length. Burning proceeds from the inside out with the surface area increasing at an even greater rate than in the embodiment illustrated in FIGS. 9B and 9E. Thus, the burn rate of the power source illustrated in FIGS. 9C and 9F will increase most rapidly as a function of geometry as burning progresses, irrespective of changes in pressure. The geometry illustrated in FIGS. 9A and 9D should be used to have pressure within the power source body 301 as the primary determinant of the burn rate.

According to certain embodiments of the non-explosive gas-generating setting tools 300 described herein, a power source 302 having a cylindrical geometry, as illustrated in FIGS. 9A and 9D, is provided as a fuel source. Such a power source may have a burn rate that is related to the pressure within power source body 301 according to the formula:

$$r=r_o+aP_c^n$$

wherein r is the burn rate, $r_o$ is typically 0, a and n are empirically determined constants, and Pc is the pressure within power source body 301.

Consider the multi-staged sequence described above for deploying a downhole tool.

When the power source 302 is activated and piston the 306 and shaft 309 begin to stroke, the volume of power source body 301 expands against a pressure that is primarily determined by the hydrostatic pressure at the downhole position of the setting tool. As the first stage of tool setting is encountered (e.g., setting the bottom slips into the ID of the wellbore), the power source body 301 volume expansion will meet with the additional pressure needed to complete that stage. The burn rate of the power source therefore increases. Once the first stage is completed, the stroke will continue and the power source body volume will continue to expand until the second stage (e.g., compressing the sealing section) is encountered. Again, the burn rate of the power source will increase under the influence of the additional pressure. As each new pressure demand is placed on the non-explosive gas-generating setting tool, the burn rate of the power source increases to compensate for that demand.

Figure 10:
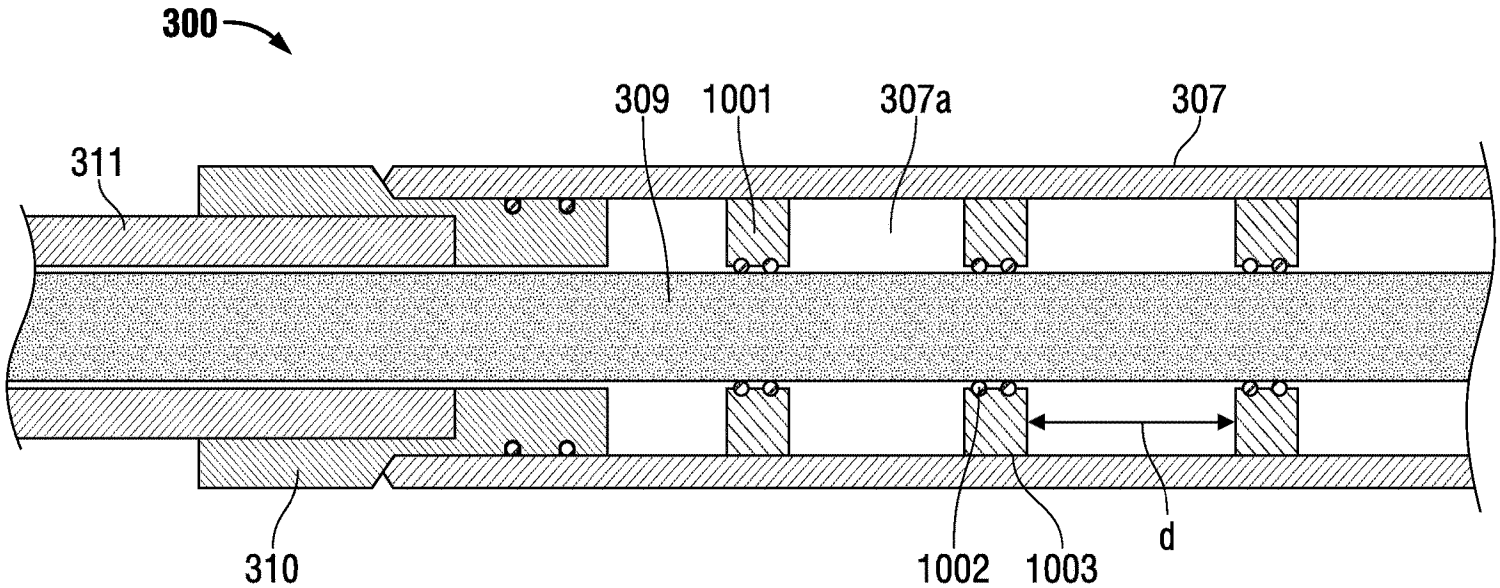
FIG. 10 illustrates a non-explosive gas-generating setting tool containing lateral support members to prevent the tool's shaft from buckling.

As the stroke length and/or the force applied over the stroke length increases, a potential mode of tool failure is buckling of the shaft 309. To prevent such failure, also known as Euler failure, the non-explosive gas-generating setting tool can be configured with lateral supports 1001 within the tool body chamber 307*a* to prevent the shaft 309 from buckling, as shown in FIG. 10. The lateral support members 1001 include o-rings 1002, which form a seal with shaft 309. The interface 1003 between the lateral support members and the ID of tool body 307 generally allows lateral support members 1001 to move axially as shaft 309 strokes downward. As shaft 309 strokes, lateral support members 1001 will sequentially come to rest against shaft sub 310. Thus, the lateral support members 1001 reduce the unsupported length of shaft 309 to a value d, which is substantially shorter than the entire length of shaft 309, thereby significantly increasing the amount of vertical load that shaft 309 can handle before buckling.

The setting tools described herein can be provided in a variety of outside diameters to fit within a variety of tubular members. Typical diameters range from about 2 cm (0.75 inches) to about 15 cm (6 inches), or greater.

The foregoing disclosure and the showings made of the drawings are merely illustrative of the principles of this invention and are not to be interpreted in a limiting sense.

The invention claimed is:

1. A well tool comprising:

a chamber configured to contain a non-explosive gas generating fuel;

a tool body comprising a cavity configured to receive pressure from the chamber, wherein the tool body comprises a first inside diameter and a second inside diameter longitudinally disposed with respect to the first inside diameter, wherein one or more o-rings disposed upon a piston form a gas-tight seal between the piston and the first inside diameter, and wherein the second inside diameter is greater than the first inside diameter;

the piston disposed within the cavity and oriented to stroke in a first direction from the first inside diameter to the second inside diameter in response to a pressure increase in the cavity, wherein the one or more o-rings do not form a gas-tight seal between the piston and the second inside diameter; and a shaft mechanically connected to the piston and stroking in the first direction with the piston in response to the pressure increase in the cavity, wherein the well tool is configured so that pressurizing the chamber by activation of the non-explosive gas-generating fuel causes the piston and shaft to stroke.

2. The well tool of claim 1, further comprising an extendable sleeve configured to actuate when the shaft is stroked in the first direction.

3. The well tool of claim 2, further comprising a mechanical linkage between the shaft and the extendable sleeve.

4. The well tool of claim 1, further comprising a mandrel configured to receive the shaft when the shaft is stroked in the first direction.

5. The well tool of claim 4, wherein the mandrel further comprises a slot, and a cross member disposed within the slot, and wherein the cross member is pushed by the shaft when the shaft is stroked in the first direction.

6. The well tool of claim 1, wherein the well tool is configured such that the shaft is a first shaft that can be exchanged for a second shaft of a different length than the first shaft.

7. The well tool of claim 6, wherein the second shaft is at least twice as long as the first shaft.

8. The well tool of claim 1, wherein the non-explosive gas-generating fuel comprises:

a quantity of thermite sufficient to generate a thermite reaction when heated in excess of an ignition temperature; and a polymer disposed in association with the thermite, wherein the polymer produces a gas when the thermite reaction occurs, wherein the gas slows the thermite reaction, wherein pressure is produced by the thermite reaction, the gas, or the combinations thereof.

9. The well tool of claim 1, further comprising a compressible member configured in relationship with the shaft such that the compressible member is compressed by the piston when the piston is stroked in the first direction, thereby decelerating the piston and shaft.

10. The well tool of claim 1, further comprising a shaft sub, wherein the shaft slides through the shaft sub in the first direction when stroked, and wherein one or more o-rings disposed within the shaft sub form a gas-tight seal between the shaft sub and the shaft.

11. The well tool of claim 10, wherein the shaft comprises a fluted section, and wherein the intersection between the fluted section and the shaft sub prevents the one or more o-rings from forming a gas-tight seal between the shaft sub and the shaft.

12. The well tool of claim 1, further comprising a first bleed sub, wherein the first bleed sub is disposed between the chamber and the tool body and configured to control pressure from the chamber as it is applied to the cavity.

13. The well tool of claim 12, further comprising a second bleed sub disposed between the chamber and the piston, wherein the second bleed sub comprises a carbon-containing disk member configured to protect components of the second bleed sub from gases generated within the chamber.

* * * * *